United States Patent [19]

Derks et al.

[11] 4,254,359

[45] Mar. 3, 1981

[54] CAMERA TUBE WITH GRADUATED CONCENTRATION OF TELLURIUM IN TARGET

[75] Inventors: Petrus J. A. M. Derks; Joannes H. J. Van Dommelen; Jan Dieleman, all of Eindhoven, Netherlands

[73] Assignee: U.S. Philips Corporation, New York, N.Y.

[21] Appl. No.: 31,260

[22] Filed: Apr. 18, 1979

[30] Foreign Application Priority Data

May 19, 1978 [NL] Netherlands ..... 7805417

[51] Int. Cl.[3] ..... H01J 29/45; H01J 31/38

[52] U.S. Cl. ..... 313/386

[58] Field of Search ..... 313/385, 386

[56] References Cited

U.S. PATENT DOCUMENTS 3,890,525 6/1975 Hirai et al. ..... 313/386

4,007,395 2/1977 Nonaka et al. ..... 313/386

FOREIGN PATENT DOCUMENTS 1135460 12/1968 United Kingdom .

OTHER PUBLICATIONS

"New Photoconductive Camera Tube, Saticon", by N. Goto et al., NHK Laboratories Note No. 170, Sep. 1973.

"Saticon: A New Photoconductive Camera Tube with Se-As-Te Target" by N. Goto et al., IEEE Transactions on Electron Devices, vol. ed. 21, No. 11, pp. 662-666, Nov. 1974.

*Primary Examiner*—Palmer C. Demeo

*Attorney, Agent, or Firm*—Marc D. Schechter

[57] ABSTRACT

A camera tube having an electron source and a target to be scanned on one side by an electron beam emanating from the source. The target comprises a signal electrode and a selenium-containing vitreous layer containing tellurium, in a concentration which varies in the direction of the thickness of the selenium-containing layer, and arsenic. The selenium-containing layer is on the side of the target to be scanned by the electron beam, the signal electrode is on the side of the target to receive radiation. The tellurium concentration in the selenium-containing layer increases from the radiation-receiving side of the layer to the side which is scanned by the electron beam in such manner that over a distance of at most 0.3 microns from the radiation-receiving side, the concentration reaches a value of at least 4½ atomic % and the arsenic concentration uniformly exceeds 1½ atomic %.

6 Claims, 2 Drawing Figures

CAMERA TUBE WITH GRADUATED CONCENTRATION OF TELLURIUM IN TARGET

BACKGROUND OF THE INVENTION

The invention relates to a camera tube having an electron source and a target. The target is, in operation, scanned on one side by an electron beam emanating from the source. The target comprises a selenium-containing vitreous layer on the side scanned by the electron beam and a signal electrode; on another, radiation-receiving side. The vitreous layer also contains tellurium, in a concentration which varies in the direction of the thickness of the selenium-containing layer, and arsenic.

A camera tube of the above-described kind is disclosed in British Patent Specification No. 1,135,460.

A problem with vitreous selenium layers is that they are comparatively insensitive to long wave length radiation. Therefore, additions such as tellurium are often used which improve sensitivity.

In addition it is important inter alia in order to achieve good operation of the camera tube, that there is good blockage against the injection of holes from the signal electrode into the selenium-containing layer so as to minimize the dark current and the lag. The dark current and the lag, however, may be considerable if sensitivity-improving substances are added in high concentrations. On the other hand, if sensitivity-improving substances are added in low concentrations, an annoyingly high operating voltage may be necessary and only a moderate sensitivity to long wave length radiation may result.

The selenium-containing layer with additions may be separated from the signal electrode by a vitreous layer of pure selenium so that there is good blockage between the signal electrode and the selenium-containing layer with additions. The disadvantage of this solution, however, is that by the use of a layer of pure selenium the glass stability is reduced (i.e. the layer has an increased tendency to crystallize) and the lag increases as compared to the above-mentioned layers having a low concentration of sensitivity-improving additions.

The above-described detrimental effect of high concentrations of sensitivity-improving additions also occurs if the additions are present in a concentration which decreases continuously from the radiation-receiving side to the side to be scanned.

In addition the glass stability of the camera tubes described in the British Patent Specification is low as a result of the low concentration of glass-stabilizing additions, for example arsenic.

SUMMARY OF THE INVENTION

One of the objects of the invention is to avoid the above-described problems at least to a considerable extent and to provide an optimally operating camera tube.

The invention is, inter alia, based on the discovery of the fact that it is possible to avoid these problems with a tellurium concentration increasing across the selenium-containing layer despite what is stated in this respect in British Patent Specification 1,135,460.

According to the invention, a camera tube of the type described above is characterized in that the tellurium concentration in the selenium-containing layer increases from its radiation receiving side to the side to be scanned by the electron beam that the concentration increases in such manner that over a distance of at most 0.3 μm from the radiation receiving side of the selenium layer the concentration reaches a value of at least 4½ atomic percent and that the arsenic concentration in the layer is uniformly greater than 1½ atomic percent.

It has been found that good properties are obtained by incorporating sensitivity-improving additions in the manner described. Among other things, the blockage against injection of holes is very satisfactory and a good sensitivity to long wave length radiation is obtained.

In addition to good glass stabilization of the selenium-containing layer, a low lag and dark current with a reasonable operating voltage are obtained.

Preferably, the tellurium concentration on the radiation-receiving side of the selenium-containing layer is also less than 7 atomic percent.

A good stability at high temperature is obtained, in particular, if the tellurium concentration on the radiation-receiving side of the selenium-containing layer is zero.

A good response rate of the camera tube is obtained when the average tellurium concentration in the selenium-containing layer is at most 12 atomic percent.

Good glass stabilization is obtained if the arsenic concentration in the selenium-containing layer exceeds 4 atomic percent. A favorable combination of properties is obtained if the sum of tellurium and arsenic concentrations on the radiation receiving side of the selenium-containing layer is less than 13 atomic percent.

The invention will now be described in greater detail with reference to a few examples and the accompanying drawing.

DESCRIPTION OF THE PREFERRED EMBODIMENTS

Figure 1:
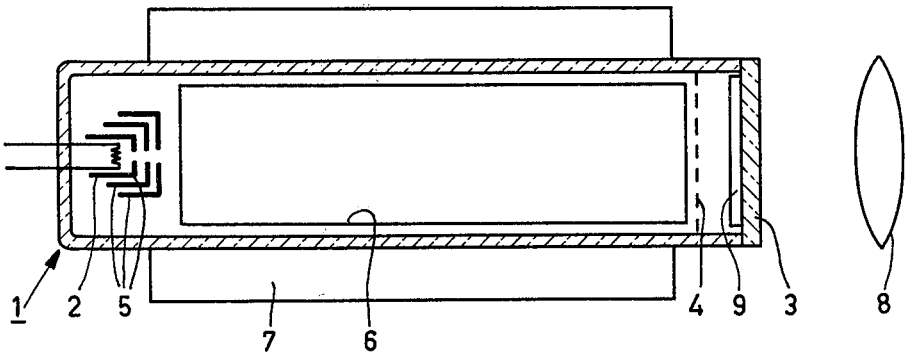
FIG. 1 shows diagrammatically a camera tube according to the invention.
Figure 2:
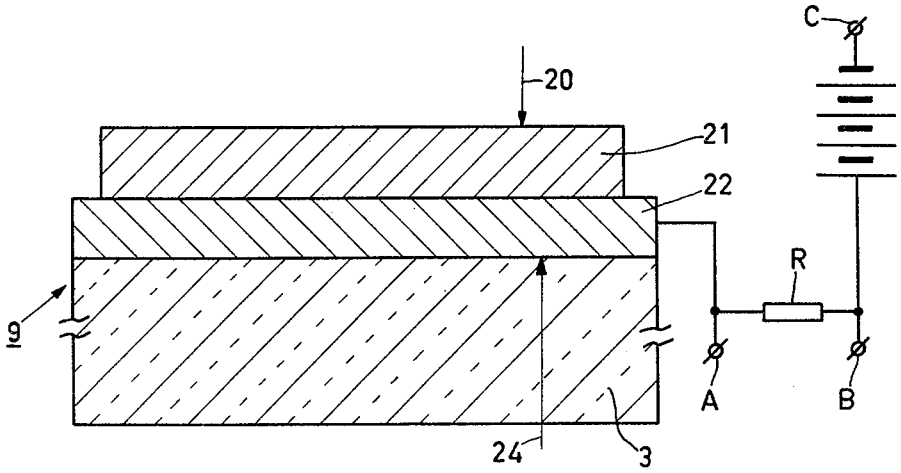
FIG. 2 is a diagrammatic sectional view of a target for a camera tube according to the invention.

The camera tube 1 as shown in FIGS. 1 and 2 has an electron source 2 and a target 9 comprising a selenium-containing glass layer 21 and a signal electrode 22. As shown in FIG. 2, target 9 is scanned on one side by an electron beam 20 emanating from the source 2. Radiation 24 is incident on another, radiation-receiving side of the target 9. Signal electrode 22 is disposed on the radiation-receiving side of target 9, and the glass layer 21 is disposed adjacent the signal electrode on the side to be scanned by the electron beam. Selenium-containing glass layer 21 contains tellurium, in a concentration which varies in the direction of the thickness of the layer, and arsenic.

According to the invention the tellurium concentration in the selenium-containing layer 21 increases from its radiation-receiving side to the side to be scanned by the electron beam 20 in such manner that over a distance of at most 0.3 μm from the radiation receiving side the concentration reaches a value of at least 4½ atomic % and the arsenic concentration in the layer 21 is uniformly greater than 1½ atomic %.

The camera tube comprises, in the usual manner, electrodes 5 for accelerating and focussing the electron beam. Furthermore, the usual means are present for deflecting the electron beam, so that the target plate 9 can be scanned. These means consist of, for example, a set of coils 7. The electrode 6 serves inter alia, to screen the tube wall from the electron beam. A scene to be recorded is projected on the target 9 by means of the lens 8, the window 3 being permeable to radiation.

Furthermore, a collector grid 4 is present in the usual manner. By means of this grid which may be, for example, an annular electrode, reflected and secondary electrons emanating, for example, from the target 9 may be dissipated.

During operation the signal electrode 22 is biased positively with respect to the electron source 2. In FIG. 2 the electron source is to be connected to the point C. Upon scanning by the electron beam 20 of the target, the latter is charged to substantially the cathode potential.

The target is then discharged fully or partially depending on the intensity of the radiation 24 which impinges on the selenium-containing layer 21. In a subsequent scanning cycle, charge is supplied again until the target has again assumed the cathode potential. This charging current is a measure of the intensity of the radiation 24. Output signals are derived from the terminals A and B via the resistor R.

EXAMPLE I

Two stainless steel vapor deposition furnaces which are coated with a thin layer of silicon nitride are placed in a vacuum vapor deposition device. Flaps are provided above the furnaces.

Flat polished glass panes having a 0.1 μm thick signal electrode 22 of tin-doped indium oxide, are placed in the vapor deposition device with said layer facing the furnaces.

4 grams of a previously synthesized homogeneous glass mixture of 10 atomic % As and 90 atomic % Se are introduced into the first furnace. In the second furnace 4 grams of a previously synthesized glass mixture consisting of 15 atomic % As., 80 atomic % Se and 5 atomic % Te are provided.

The vapor deposition device is evacuated to a residual pressure of $10_{-6}$ mm Hg after which both furnaces are heated to a constant temperature of approximately 335° C.

During heating, a flap is present above the furnaces. After heating, the flap above the first furnace is opened, and then closed at the instant at which a 0.1 μm thick amorphous photoconductive layer has been deposited on the signal electrode 22.

The flap above the second furnace is then opened and a 3 μm thick amorphous photo-conductive layer is deposited on the last-mentioned layer, after which the flap is closed again. The two deposited photoconductive layers together constitute the selenium-containing layer 21.

An X-ray fluorescence analysis has demonstrated that the first photoconductive layer comprises approximately 9 atomic % As and approximately 91 atomic % Se and that the second photoconductive layer comprises a content of 5 atomic % Te which is constant substantially throughout the thickness, a content of 10 to 11 atomic % As increasing slightly from the first photoconductive layer, and 85 to 84 atomic % of Se.

The resulting substrates are assembled on a television camera tube and the photoelectric properties are evaluated.

At the optimum signal electrode voltage in this case approximately 40 V, a linear light transmission characteristic, a spectral sensitivity corresponding approximately to that of the Plumbicon, a good light response rate, a low dark current ($< 0.4$ nA/cm$^2$), a high resolving power (approximately 70% modulation depth at 4 MHz and a scan format of $8.8 \times 6.6$ mm), a good picture quality and an absence of burning-in phenomena are observed. optimum voltage is to be understood to mean herein the maximum permissible voltage between signal electrode and electron beam at which the properties characteristic of too high a voltage, for example, too high a dark current (more than a few nA/cm$^2$), do not yet occur.

EXAMPLE II

A vacuum vapor deposition device is again prepared as in the preceding Example.

A homogeneous glass mixture consisting of 10 atomic % As and 90 atomic % Se is again introduced into the first furnace and Te is introduced into a second furnace having an aluminium oxide tray. After evacuation and heating to a constant temperature of 335° C. in the first furnace a flap below the windows is removed in such manner that an amorphous photoconductive layer of approximately 0.1 μm thickness is deposited from the glass mixture in the first furnace on one half of a glass pane provided with a tin-doped indium oxide layer.

The flap is then removed so that the layer formation over the whole surface is continued until an amorphous photoconductive layer of 0.1 μm thickness has again been deposited on the substrates.

The flap above the second furnace which is kept at a temperature of approximately 450° C. is then also removed after which an approximately 4 μm thick amorphous photoconductive layer of As, Se and Te is deposited. The deposition rate is approximately 0.2 μm/minute and the deposition time is approximately 20 minutes. After the desired layer thickness has been reached, the flap above the furnaces is closed.

Chemical analysis has demonstrated that the 0.1 thick layers consist of approximately 9 atomic % As and approximately 91 atomic % Se and the 4 μm thick layer consists of approximately 9 atomic % As, 82.5 atomic % Se and 8.5 atomic % Te.

The substrates thus manufactured are assembled on a television camera tube and evaluated for their photoelectric properties as in the preceding Example. These properties readily correspond to those found in the preceding Example, and in fact, the spectral sensitivity has increased, in particular at longer wavelengths.

The properties prove not to be dependent on the thickness of the tellurium-free layer portion.

EXAMPLE III

A vacuum vapor deposition device is again prepared as described in the first Example. A previously synthesized homogeneous glass mixture of 10 atomic % As and 90 atomic % Se is introduced into the first furnace and a homogeneous glass mixture of 10 atomic % As, 82 atomic % Se and 8 atomic % Te is introduced into the second furnace.

After evacuating the vapor deposition device, the first furnace is heated to a constant temperature of approximately 320° C. and the second furnace to approximately 340° C.

An opening is made between the furnaces and the substrates while the furnaces are simultaneously moved relative to the opening in such manner that the vapor depositing on the substrates initially originates only from the first furnace and is then gradually replaced by vapor from the second furnace.

The furnace movement is completed in approximately 15 seconds in which time a 0.1 μm thick photoconductive layer is deposited on the substrates. The evaporation from the second furnace is continued for another 8 minutes in which time an amorphous 4 μm thick photoconductive layer is deposited.

X-ray fluorescent analysis has demonstrated that the arsenic content in the photoconductive layer is substantially constant and equals 7 atomic %, while the tellurium content on the radiation-receiving side of the layer is substantially zero and then increases rapidly over a layer thickness of 0.1 μm to approximately 6.5 atomic % and then remains constant throughout the remainder of the layer.

Targets thus manufactured results in camera tubes which, when measured photoelectrically as in Example 1, show properties which are comparable to those of the camera tubes described in the Example at an optimum signal electrode voltage of approximately 30 V.

The invention is not restricted to the above Examples but may be varied in various manners without departing from the scope of this invention.

In addition to tellurium, other additions improving the sensitivity to long-wave radiation, for example cadmium, iodine or antimony, may be used. Concentrations of at most 1000 ppm are very suitable for iodine additions.

In order to suppress secondary electron emission from and electron injection into the selenium containing layer, a layer of, for example, antimony trisulphide may be provided on the selenium-containing layer on the scanning side.

Between signal electrode and selenium-containing layer a thin layer, for example of cadmium selenide, gallium sulphide glass or molybdenum trioxide ($MoO_3$) may also be provided. In addition to arsenic, phosphorus and/or germanium may also be used as a glass-stabilizing addition.

What is claimed is:

1. A camera tube comprising an electron source and a target, said target having a radiation receiving side and a side to be scanned by an electron beam emanating from the electron source, said target comprising a signal electrode on the radiation-receiving side adjacent a selenium-containing vitreous layer on the side to be scanned by the electron beam, said selenium-containing layer further comprising arsenic, characterized in that the selenium-containing layer further comprises tellurium in a concentration which increases from the radiation-receiving side to the side to be scanned by the electron beam in such manner that over a distance of at most 0.3 microns from the radiation-receiving side of the selenium-containing layer the concentration reaches a value of at least 4½ atomic %, the tellurium concentration thereafter not decreasing in the selenium-containing layer, and the arsenic concentration uniformly exceeds 1½ atomic %.

2. A camera tube as claimed in claim 1, characterized in that the tellurium concentration in the selenium-containing layer on the radiation-receiving side is less than 7 atomic %.

3. A camera tube as claimed in claim 2, characterized in that the tellurium concentration in the selenium-containing layer on the radiation-receiving side is zero.

4. A camera tube as claimed in claim 3, characterized in that the average tellurium concentration in the selenium-containing layer is at most 12 atomic %.

5. A camera tube as claimed in claim 3, characterized in that the arsenic concentration in the selenium-containing layer exceeds 4 atomic %.

6. A camera tube as claimed in claim 5, characterized in that the sum of the tellurium and arsenic concentrations on the radiation-receiving side of the selenium-containing layer is less than 13 atomic %.

* * * * *